US006482063B1

(12) United States Patent
Frigard

(10) Patent No.: US 6,482,063 B1
(45) Date of Patent: Nov. 19, 2002

(54) ARTICULATING BLOCKS TOY

(76) Inventor: Charles Raymond Frigard, 2875 Halstead La., Mound, MN (US) 55364

( * ) Notice: Subject to any disclaimer, the term of this patent is extended or adjusted under 35 U.S.C. 154(b) by 0 days.

(21) Appl. No.: 09/715,499

(22) Filed: Nov. 17, 2000

Related U.S. Application Data

(60) Provisional application No. 60/166,216, filed on Nov. 18, 1999.

(51) Int. Cl.[7] ..... A63H 33/00
(52) U.S. Cl. ..... 446/119; 446/122; 446/124
(58) Field of Search ..... 446/119, 120, 446/121, 122, 123, 124, 125, 126, 85, 106, 116

(56) References Cited

U.S. PATENT DOCUMENTS

| | | | | | |
|---|---|---|---|---|---|
| 956,632 | A | * | 5/1910 | Finch | 446/119 |
| 2,825,178 | A | * | 3/1958 | Hawkins | 446/126 |
| 4,997,375 | A | * | 3/1991 | Heinz | 446/119 |
| 5,302,148 | A | * | 4/1994 | Heinz | 446/119 |

* cited by examiner

*Primary Examiner*—Jacob K. Ackun
(74) *Attorney, Agent, or Firm*—Dorsey & Whitney LLP

(57) ABSTRACT

The present invention is a toy that can be manipulated to form various configurations. The toy include a plurality of blocks, many of which have a combination of slots with or without holes and are held together by an elastic cord. The combination of slots and holes together with the elastic nature of the cord allows the user to change the relative relationship of any given block to the block adjacent to it.

18 Claims, 4 Drawing Sheets

ARTICULATING BLOCKS TOY

This application is based on U.S. Provisional Application No. 60/166,216 filed Nov. 18, 1999, and claims under 35 U.S.C. § 119(e), the benefit of U.S. Provisional Application No. 60/166,216.

SUMMARY OF THE INVENTION

The present invention relates to toys. More specifically, the present invention relates to toys that children and adults can manipulate to form various configurations. The present invention is designed to be simple, while at the same time providing the user with a maximum number of options. for forming and reforming the toy into the those configurations.

The present invention is a toy made from wood shapes or blocks that are slotted and/or drilled and held together by an elastic cord. It should be understood that the blocks could be made from plastic, stone, metal or other suitable materials. The number and shape of the blocks can vary depending on the toy theme. Depending on the materials used the blocks may be clear coated, stained, or painted. While being held together by the elastic cord, the slotted/drilled blocks can be manipulated into a wide variety of structures, shapes, or animated poses that look like known or fanciful animals or things.

Some of the blocks may be designed to look like certain body parts, such as a dog's head, women's waist, and horse's neck. The number of blocks used can be sufficient to create multiple appendages and multiple joints for at least some of the appendages (See FIG. 1). By doing so the user can configure the toy of the present invention to include—for example—a hip joint, knee joint and foot.

Separate toys or groups of blocks can be placed together to construct larger structures or settings consisting of multiple animals.

The design and advantages of the present invention will become apparent upon review of the drawings and detailed description which follows:

DETAILED DESCRIPTION OF THE INVENTION

Figure 1:
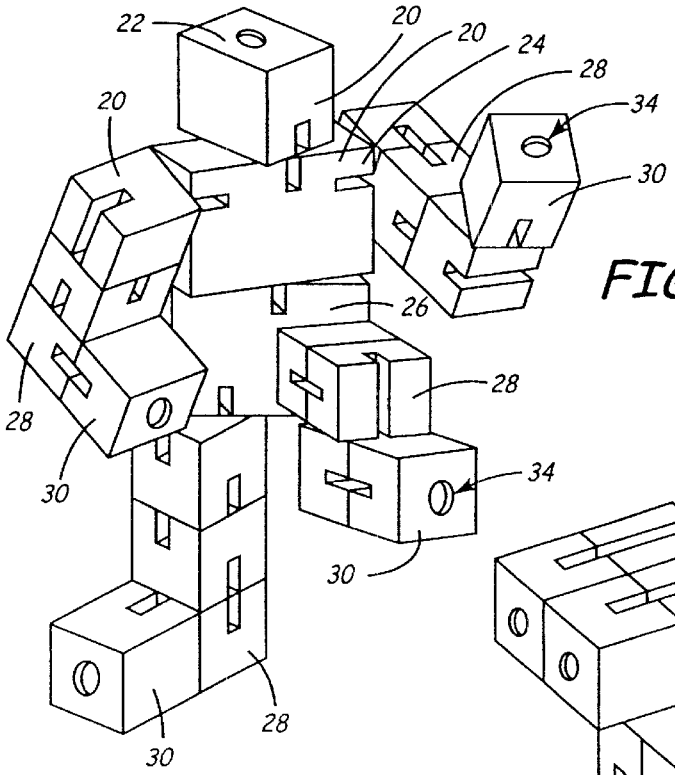
FIG. 1 is an isometric view of the present invention with the blocks configured to represent a marching or walking person.
Figure 6:
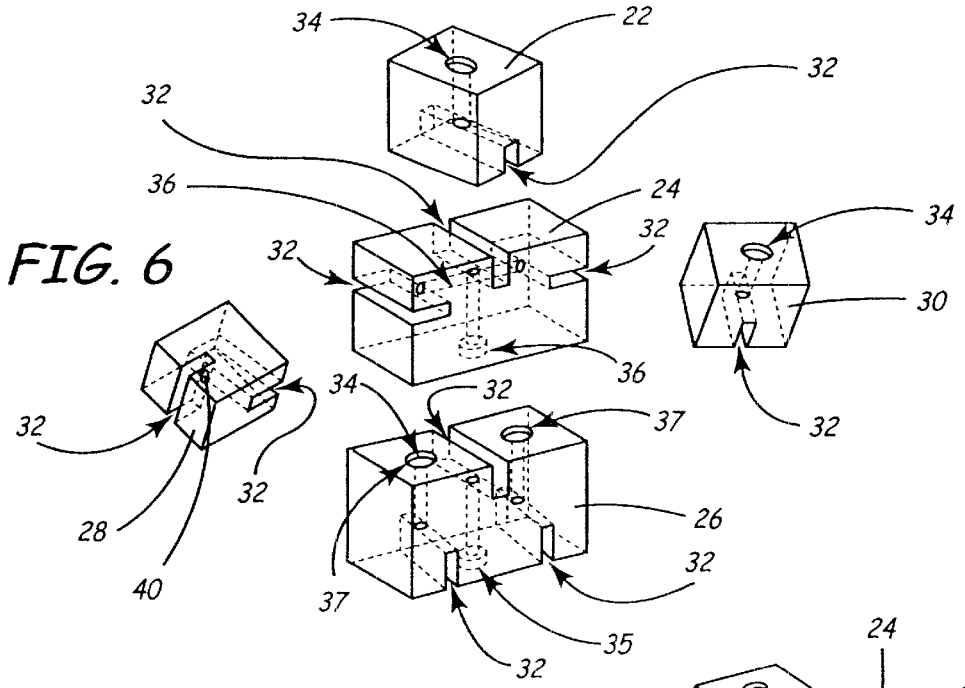
FIG. 6 is view of the five different types of blocks of the present invention used to construct the articulating block toy depicted in FIGS. 7*a*–7*c* without any connecting elastic cord.

The articulating block unit of the embodiment shown in FIG. 1 consists of five main block types 20 as shown in FIG. 6. The five main block types 20 include a head, or end block 22, an upper torso block 24, a lower torso, or base block 26, an appendage block 28, and a terminal block 30. As will be noted in FIG. 6, the blocks 20 have various combinations and arrangements of slots 32 and countersunk holes 34 and holes 36.

The head block 22 has a countersunk hole 34 that extends into a slot 32. The upper torso block 24 has a hole 36 that connects with two slots 32, and a third slot 32 that connects to a hole 36. The lower torso block 26 has three slots 32 and three countersunk holes 34. Each slot 36 of the lower torso block 26 is connected to one countersunk hole 34 of the lower torso block 26. The appendage block 28 has two slots 32 at 90° angles to each other that—when cut—form a through-hole 40. The terminal block 30 has one slot 32 and one countersunk hole 34 that connects to the slot 32.

Figure 5A:
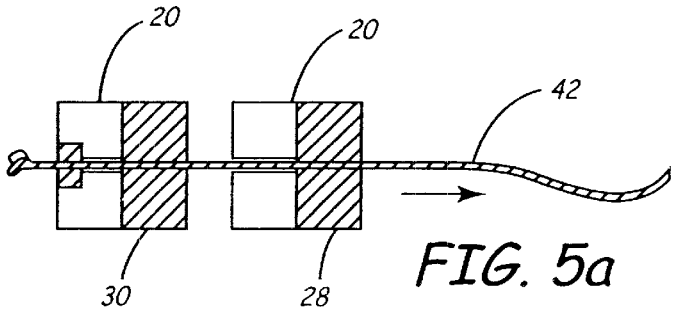
FIG. 5*a* is a side view of two blocks from FIG. 1 that have been cut in half and a portion of an elastic cord of the present invention showing a countersunk hole (to hide the knot in the cord) in an end of one block, a drilled hole, the slots and the relationship of the elastic cord to the slots and countersunk hole of the block when the blocks are aligned in a linear relationship.
Figure 5B:
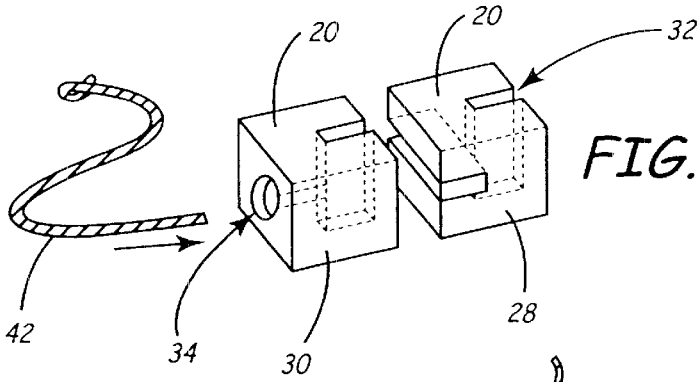
FIG. 5*b* is a side view of two blocks from FIG. 1 with a portion of an elastic cord of the present invention pulled out of the blocks showing the relationship of the slots and holes to the blocks.
Figure 5C:
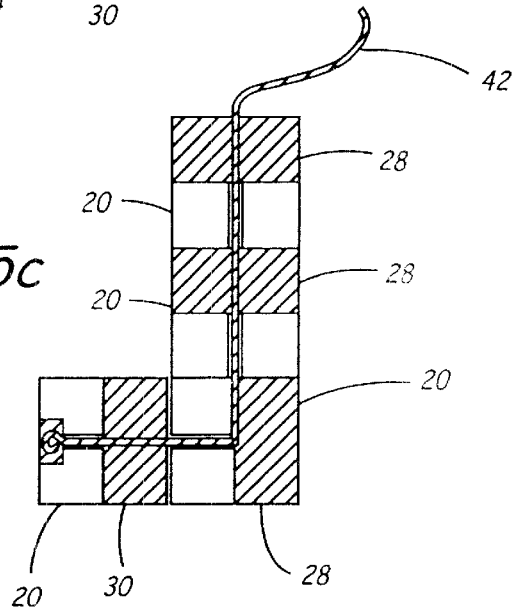
FIG. 5*c* is a side view of four blocks from FIG. 1 that have been cut in half to show the relationship of the elastic cord to the slots of the block when the blocks are aligned in a combined linear relationship and angular relationship.

All blocks 20 that make-up an articulating block toy of the present invention are connected by an elastic cord or rubber binder 42 which allows each block 20 to be moved to different, but connected positions, in relationship to an adjacent block or blocks 20. The relationship of the elastic cord 42 to a group of blocks 20 can be seen in FIGS. 5*a*–5*c*. In particular, FIG. 5*c* shows how the elastic cord 42 maintains a group of blocks 20 in both linear and angular positions. The elastic quality of the cord 42 enables adjacent blocks 20 to be pulled apart a sufficient distance so that they can be rotated and/or moved in an angular direction relative to an adjacent block or blocks 20.

With reference to FIG. 6, four elastic cords (not shown) would be used with the five types of blocks 20 shown, and with the additional appendage blocks 28 and terminal blocks 30 needed to build the articulating block toy invention shown in FIGS. 1, 4 and 7*a*–7*c*. One elastic cord 42 would join the one terminal "hand" block 30 to the other terminal "hand" block 30 by passing through the upper torso hole 36 and slots 32, through appendage "arm" blocks 28, and through the terminal "hand" blocks 30. The elastic cord 42 would be under sufficient tension so that when the ends were knotted they would be drawn into the countersunk holes 34 of the terminal "hand" blocks 30, thus pulling the set of blocks 20 together in a moveable relationship.

A second elastic cord (not shown) would similarly interconnect the lower torso block 26, upper torso block 24, and head block 22. This second elastic cord 42 also would be under sufficient tension so that when the ends were knotted, one knotted end would be drawn into the countersunk hole 34 in the head block 22 and the second knotted end would be drawn into the bottom middle countersunk hole 35 in the lower torso block 26, thus pulling the three blocks 20 together in a moveable relationship.

Finally a third and fourth elastic cord (not shown) would be similarly used to interconnect two sets of appendage "leg" blocks 28 and terminal "foot" blocks 30 to the lower torso block 26. More specifically, one elastic cord 42 would join the one terminal "foot" block 30 to the one side of the lower torso block 26 by passing through one of the lower torso's side countersunk hole 37 and slot 32, through the appendage "leg" blocks 28, and through a terminal "foot" block 30. The elastic cords 42 would be under sufficient tension so that when the ends were knotted one knotted end of each elastic cord 42 would be drawn into one of the countersunk holes 37 in one side of the lower torso block 26 and the second knotted end of each elastic cord 42 would be drawn into each of the terminal "foot" blocks 30, thus pulling the all the blocks 20 together in a moveable relationship.

Figure 7A:
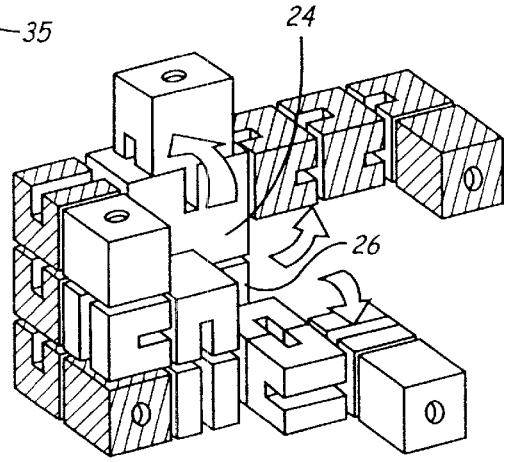
FIGS. 7*a*–7*c* are isometric views of the blocks of the present invention transformed in stages from the cubic formation depicted in FIG. 4 into a standing person.
Figure 7B:
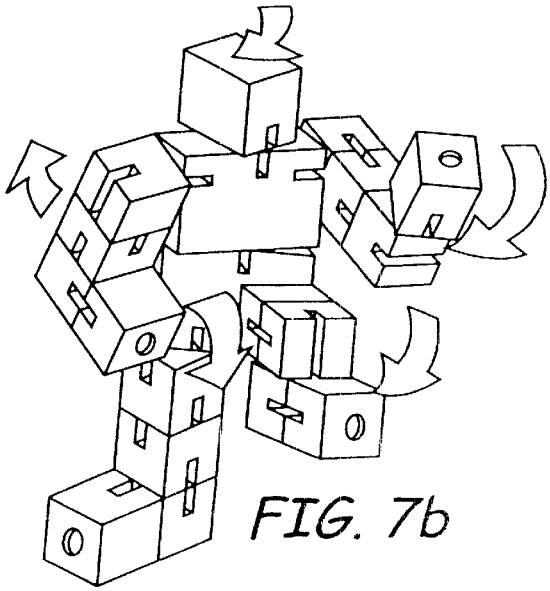
Figure 7C:
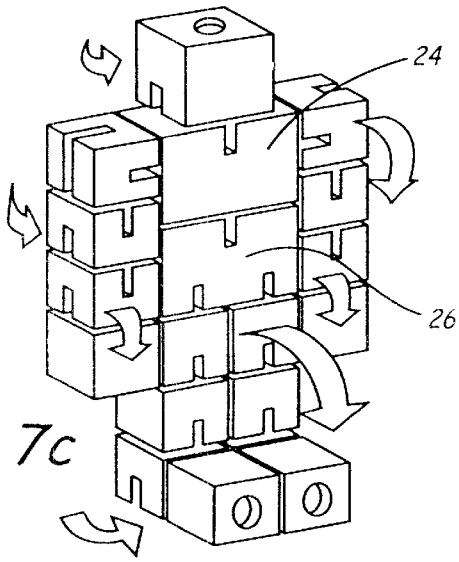
Figure 8:
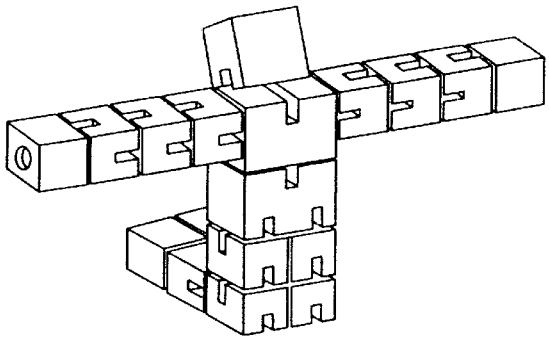
FIG. 8 is an isometric view of the blocks of the present invention configured to represent a human expressive state.
Figure 9:
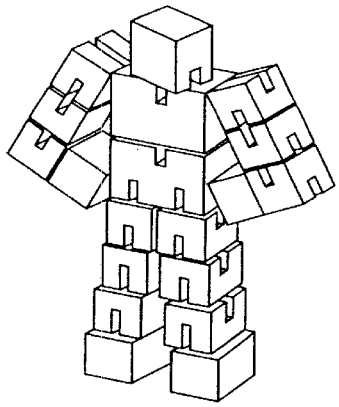
FIG. 9 is an isometric view of the blocks of the present invention configured to represent another human expressive state.
Figure 10:
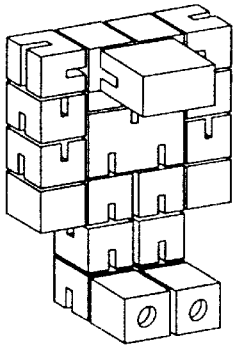
FIG. 10 is an isometric view of the blocks of the present invention configured to represent yet another human expressive state.
Figure 11:
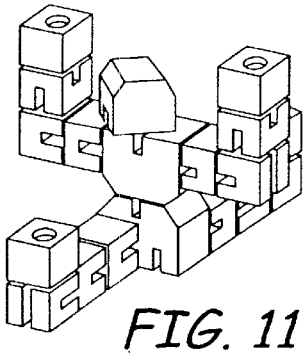
FIG. 11 is an isometric view of a different set of blocks of the present invention with modified torso blocks to depict a woman figure when configured as shown.

In use, the articulating blocks 20 can be used to make animal and/or inanimate shapes as depicted in FIGS. 1–4 and 7*a*–7*c*. The articulating blocks 20 enable a user to rearrange the blocks 20 to create an animate object (e.g. a person) from an inanimate object (e.g. a cube). For example, FIGS. 4 and 7*a*–7*c* show the transformation of the articulating block invention from an inanimate cube to a standing man. FIG. 7*a* shows the left arm swinging up 90° and the left leg rotating down away from the torso blocks 24, 26, as indicated by the arrows. FIG. 7*b* shows the head rotating to the toy's right, the left arm swinging to the side of the torso, the left leg rotating 90° at the knee, the right arm swinging back 45° and then the right leg blocks becoming aligned so they are straight legged with the foot outward at a 45° angle, as shown by the arrows. FIG. 7*c* shows the head rotating to face straight ahead, the left arm and hand swing down along the torso blocks 24, 26, the left leg pivoting at the thigh and knee to stand straight legged with the right leg, and the right arm and hand aligned with the side of the torso blocks 24, 26, as shown by the arrows.

Figure 2:
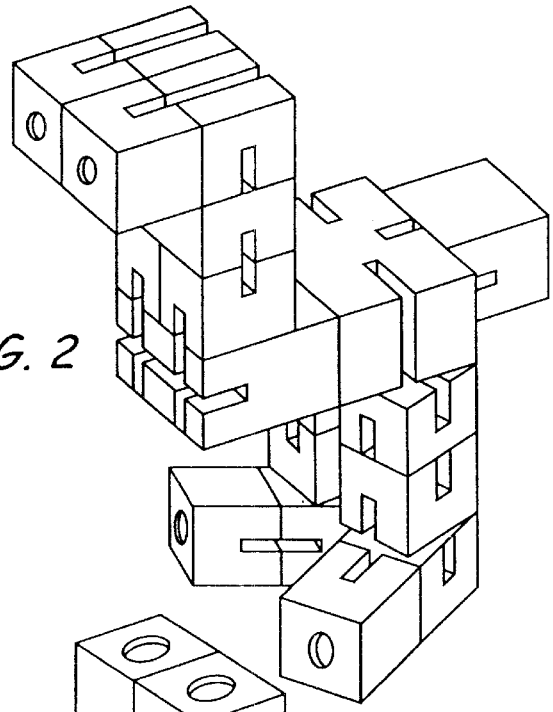
FIG. 2 is an isometric view of the blocks of FIG. 1 reconfigured to create a fanciful representation of an ostrich.
Figure 3:
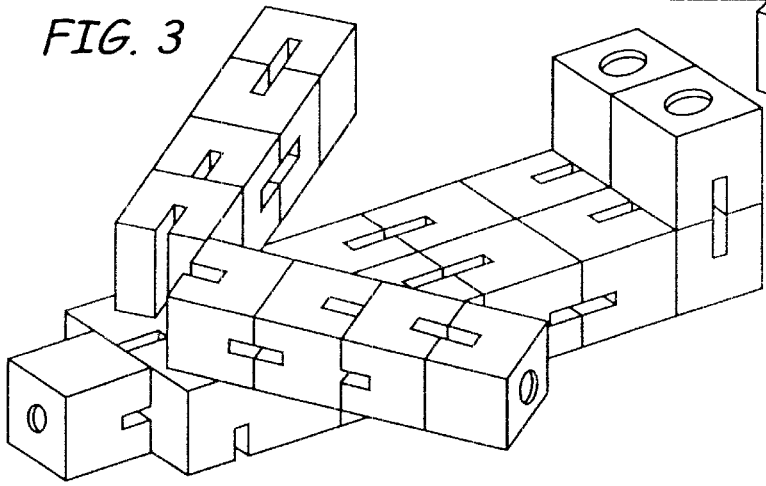
FIG. 3 is an isometric view of the blocks of FIG. 1 reconfigured to create a fanciful representation of an airplane.
Figure 4:
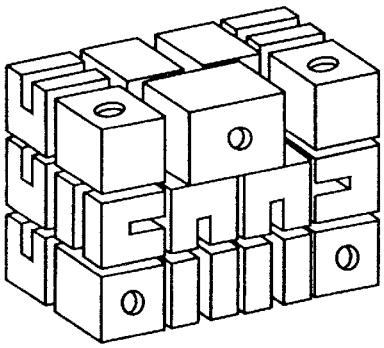
FIG. 4 is an isometric view of the blocks of the present invention configured to form a generally solid block.
Figure 12:
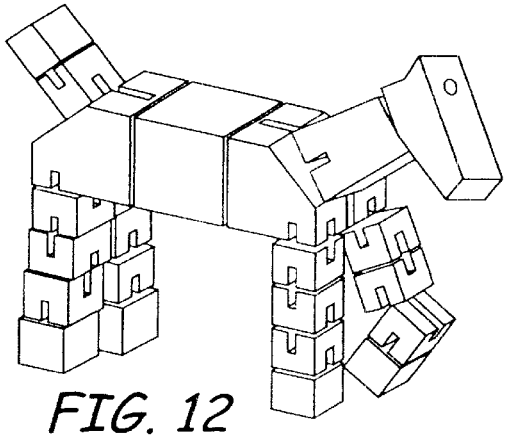
FIG. 12 is an isometric view of another set of different blocks of the present invention made to represent a horse when configured as shown.
Figure 13:
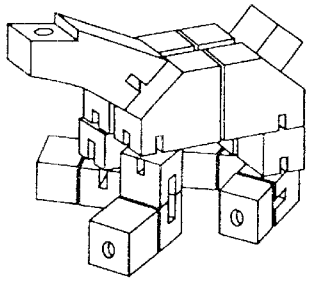
FIG. 13 is an isometric view of yet another set of different blocks of the present invention made to represent a dog when configured as shown.

Not only can an articulating block toy be used to make various shaped objects as shown in FIGS. 1–3, but they can be used to depict a variety of expressions, and poses as shown in FIGS. 8–11. The blocks 20 can be manufactured in a variety of shapes to depict other specific animate or inanimate objects such as the woman gymnast shown in FIG. 11, the horse shown in FIG. 12, and the dog shown in FIG. 13.

Other uses of the articulating block toy of the present invention include using the a brain teaser puzzle. For example, the challenge could be to manipulate the blocks 20 from the standing man shown in FIG. 1 to the cube shape shown in FIG. 4 in the shortest period of time. The articulating block toy also could be used as an aid in three-dimensional drawing as it can be set in almost any position that is possible by the human body.

The blocks 20 can be made of wood, plastic, metal or stone. The cord 42 can be made of nylon covered rubber strands or any other relatively thin elastic material. The preferred material for the blocks 20 is wood, because of its perceived quality, sound, feel, and warmth. The preferred material for cord 42 is multi-strand rubber covered with braided nylon because it has great strength while allowing flexibility.

Although a description of the preferred embodiment has been presented, it is contemplated that various changes, including those mentioned above, could be made without deviating from the spirit of the present invention.

I claim:

1. A toy comprising:

at least five blocks, each said block having a first slot that lies in a first plane, and a second slot that is interconnected with the first slot and lies in a second plane that intersects the first plane;

at least one elastic cord that maintain said at least five blocks in an interrelated and moveable relationship to each other;

at least two end blocks having at least one slot and having at least one countersunk hole, wherein said at least one countersunk hole extends into at least one slot of said end blocks; and at least one base block comprising;

a first slot that lies in a first plane;

a second slot that lies in a second plane generally parallel with the first plane;

a third slot that lies in a third plane generally parallel with the first plane;

first countersunk hole located in the first plane that extends into the first slot;

a second countersunk hole located in the second plane that extends into the second slot; and a third countersunk hole located in the third plane that extends into the third slot.

2. The toy of claim 1, wherein all of said blocks are maintained in an interrelated and moveable relationship to each other by elastic cords.

3. The toy of claim 2, wherein said blocks have more than one shape.

4. The toy of claim 2, wherein at least one of said blocks is in the shape of an animal head.

5. The toy of claim 4, wherein at least one of said blocks has a rectangular face.

6. The toy of claim 5, wherein at least one of said blocks has a square face.

7. The toy of claim 1, wherein the toy can be reconfigured from the shape of a generally solid block having at least four rectangular faces into the shape of an animal.

8. A toy comprising:

(i) a first block comprising a slot and an aperture that extends into the slot;

(ii) a second block comprising a first slot located on a first face of the second block, a second slot located on a second face of the second block, the second face being generally perpendicular to the first face, a third slot located on a third face of the second block, the third face being generally perpendicular to the first face, and generally parallel to the second face, a first aperture extending from a fourth face of the second block to the first slot, the fourth face being generally parallel to the first face and generally perpendicular to the second face, a second aperture extending from the second slot to the first slot, and a third aperture extending from the third slot to the first slot;

(iii) a third block comprising a first face and a second face being generally parallel to each other, and three apertures extending between the first face and second face, wherein the apertures lie in three separate planes generally parallel to each other;

(iv) a fourth block comprising a first slot located on a first face of the fourth block and lying in a first plane, and a second slot located on a second face of the fourth block, the sect slot being interconnected with and lying in a second plane that intersects the first plane, the second face of the fourth block being generally parallel with the first face of the fourth block; and (v) an elastic cord which keeps the blocks in an interrelated and moveable relationship to each other.

9. The toy of claim 8, wherein the toy can be configured to form the shape of a human being, comprising:

a head comprising one first block;

an upper torso comprising one second block which is connected to the head;

a lower torso comprising one third block which is connected to the upper torso;

two upper appendages, each upper appendage comprising three fourth blocks and one first block, with one of the fourth blocks of each upper appendage connected to the upper torso; and two lower appendages, each lower appendage comprising three fourth blocks and one first block, with one of the fourth blocks of each lower appendage connected to the lower torso.

10. The toy of claim 8, wherein said blocks have more than one shape.

11. The toy of claim 8, wherein at least one of said blocks is in the shape of an animal head.

12. The toy of claim 8, wherein at least one of said blocks has a rectangular face.

13. The toy of claim 8, wherein at least one of said blocks has a square face.

14. The toy of claim 8, wherein the toy can be configured to form the shape of a dog, comprising:

a head comprising one first block;

an upper torso comprising one second block which is connected to the head;

a lower torso comprising one third block which is connected to the upper torso;

two upper appendages, each upper appendage comprising three fourth blocks and one first block, with one of the fourth blocks of each upper appendage connected to the upper torso; and two lower appendages, each lower appendage comprising three fourth blocks and one first block, with one of the fourth blocks of each lower appendage connected to the lower torso.

15. The toy of claim 8, wherein the toy can be configured to form the shape of a horse, comprising:

a head comprising one first block;

an upper torso comprising one second block which is connected to the head;

a lower torso comprising one third block which is connected to the upper torso;

two upper appendages, each upper appendage comprising three fourth blocks and one first block, with one of the fourth blocks of each upper appendage connected to the upper torso; and two lower appendages, each lower appendage comprising three fourth blocks and one first block, with one of the fourth blocks of each lower appendage connected to the lower torso.

16. The toy of claim 8, wherein the toy can be reconfigured from the shape of a block having at least four rectangular faces into the shape of an animal.

17. A toy consisting essentially of:

(i) five first blocks, each first block having a slot and having a countersunk hole, wherein said countersunk hole extends into said slot;

(ii) a second block having a first slot located on a first face of the second block, a second slot located on a second face of the second block, the second face being generally perpendicular to the first face, a third slot located on a third face of the second block, the third face being generally perpendicular to the first face and generally parallel to the second face, a first aperture extending from a fourth face of the second block to the first slot, the fourth face being generally parallel to the first face and generally perpendicular to the second face, a second aperture extending from the second slot to the first slot, and a third aperture extending from the third slot to the first slot;

(iii) a third block having a first slot that lies in a first plane, a second slot that lies in a second plane generally parallel with the first plane, a third slot that lies in a third plane generally parallel with the first plane, a first countersunk hole located in the first plane that extends into the first slot, a second countersunk hole located in the second plane that extends into the second slot, and a third countersunk hole located in the third plane that extends into the third slot;

(iv) twelve fourth blocks, each fourth block having a first slot located on a first face of the fourth block and lying in a first plane, and a second slot located on a second face of the fourth block, the second slot being interconnected with and lying in a second plane that intersects the first plane, the second face of the fourth block being generally parallel with the first face of the fourth block; and (v) at least one elastic cord which keeps the blocks in an interrelated and moveable relationship to each other.

18. The toy of claim 17, wherein the toy can be configured to form the shape of a human being, the toy consisting essentially of:

a head consisting essentially of one first block;

an upper torso consisting essentially of one second block which is connected to the head;

a lower torso consisting essentially of one third block which is connected to the upper torso;

two upper appendages, each upper appendage consisting essentially of three fourth blocks and one first block, with one of the fourth blocks of each upper appendage connected to the upper torso; and two lower appendages, each lower appendage consisting essentially of three fourth blocks and one first block, with one of the fourth blocks of each lower appendage connected to the lower torso.

* * * * *